United States Patent [19]

Bridges

[11] Patent Number: 4,862,839

[45] Date of Patent: Sep. 5, 1989

[54] MULTIPORT MANIFOLD

[76] Inventor: Paul D. Bridges, 1211 Brandywine Cir., Batavia, Ill. 60510

[21] Appl. No.: 163,553

[22] Filed: Mar. 3, 1988

[51] Int. Cl.[4] ..... F02M 35/04

[52] U.S. Cl. ..... 123/52 MV; 123/580

[58] Field of Search ..... 123/52 M, 52 MV, 52 MC, 123/73 A, 73 C, 73 V, 73 B, 579, 580

[56] References Cited

U.S. PATENT DOCUMENTS

| | | | |
|---|---|---|---|
| 4,321,978 | 3/1982 | Tominaga et al. | 123/73 A |
| 4,345,551 | 8/1982 | Bloemers | 123/73 A |
| 4,543,921 | 10/1985 | Torigai et al. | 123/73 A |
| 4,671,216 | 6/1987 | Itoh | 123/52 MV |
| 4,686,944 | 8/1987 | Hiraoka et al. | 123/52 MV |
| 4,711,225 | 12/1987 | Holderle et al. | 123/52 M |

FOREIGN PATENT DOCUMENTS

| | | | |
|---|---|---|---|
| 1277260 | 10/1961 | France | 123/52 M |
| 0167871 | 10/1983 | Japan | 123/52 MV |

*Primary Examiner*—David A. Okonsky

*Attorney, Agent, or Firm*—Hill, Van Santen, Steadman & Simpson

[57] ABSTRACT

A manifold is provided for a multicylinder engine, particularly a motorcycle engine, wherein separate, independent passages are provided to connect separate carburetors to individual cylinder inlet ports. A plurality of such passages are provided in a single manifold casting, preferably each passage having a constant cross-sectional area throughout its length and all passages being identical in cross-sectional area and length. The actual cross-sectional shape of each passage may vary along its length due to space restriction for said manifold.

9 Claims, 1 Drawing Sheet

FIG. 2
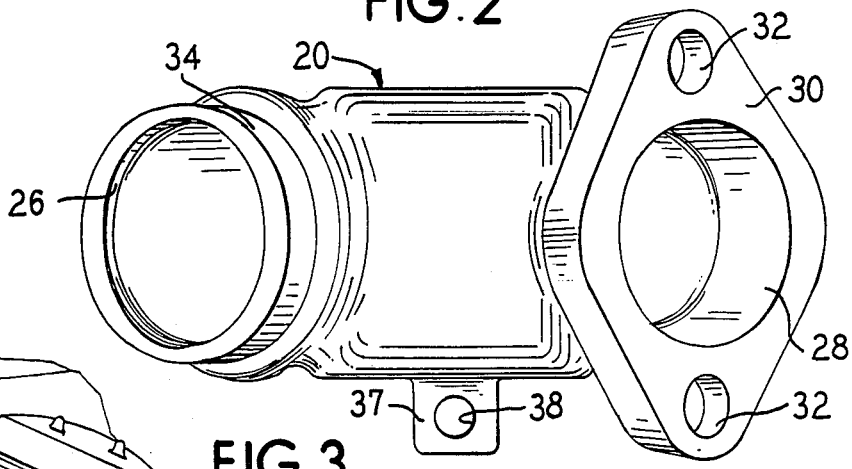
FIG. 1
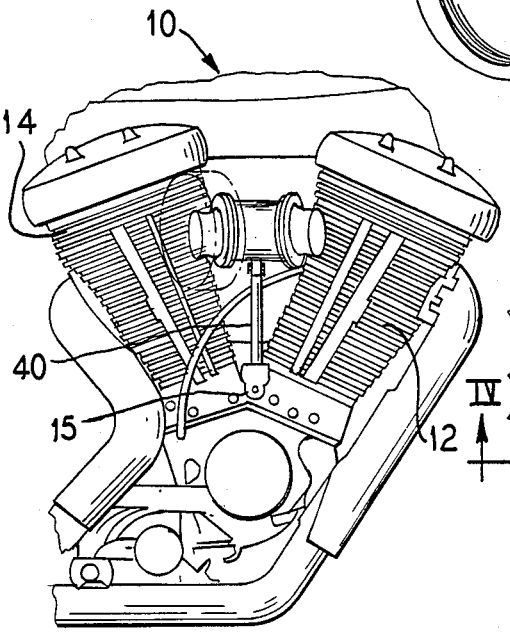
FIG. 3
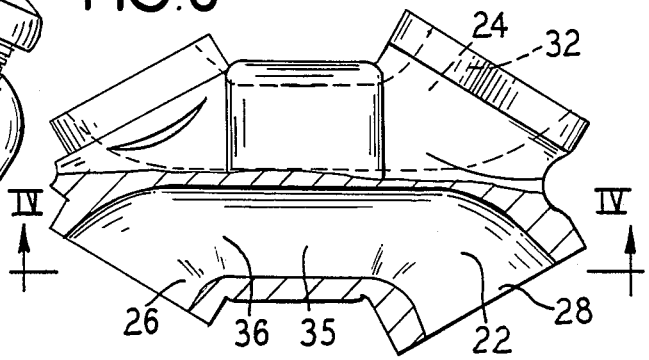
FIG. 4
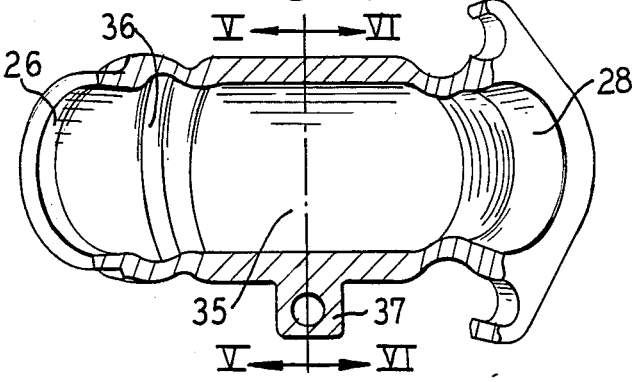
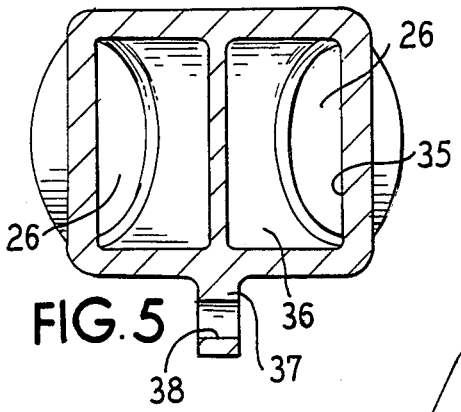
FIG. 5
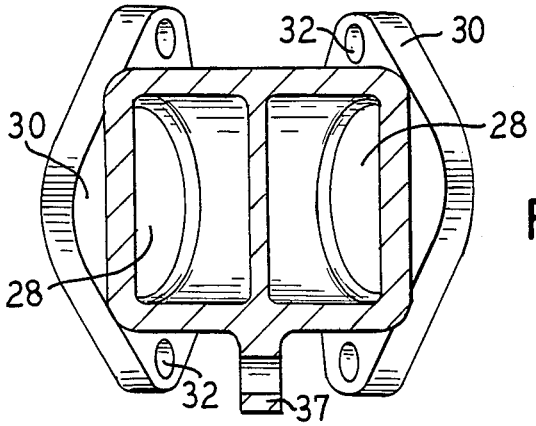
FIG. 6

MULTIPORT MANIFOLD

BACKGROUND OF THE INVENTION

1. Field of the Invention

The invention relates to a manifold for an engine and more particularly to a multiport manifold for a multicylinder engine.

2. Description of the Prior Art

Multicylinder engines are used in a variety of devices, such as motorized vehicles including motorcycles.

Two cylinder motorcycle engines, such as those commonly used on a Harley Davidson motorcycle are arranged in a V configuration in which the two cylinders are in line longitudinally on the motorcycle but are set at an angle such that a forward cylinder is angled slightly forwardly and a rear cylinder is angled slightly rearwardly to form a V shape when viewed from the side. The intake ports for the cylinders are located adjacent to one another at the inside of the V. Generally a single carburetor is provided since the cylinders fire alternatively and a single manifold connects the carburetor to the two inlet ports, the manifold having one port at a first connected to the carburetor and two ports at the second end one connected to each of the inlet ports.

Such a construction has disadvantages in that during an intake stroke, the air-fuel mixture is drawn toward one of the outlet ports of the manifold and, therefore away from the other port. When the first intake port closes and the opposing intake port opens, some time is needed for the air-fuel mixture to move from the now closed port to the now open port.

In some instances, it is desirable to utilize two separate carburetors, one for each cylinder, but because of the tight space requirements it is very difficult to arrange manifolds from the separate carburetors to the separate cylinders without excessive bending and constricting of the manifold passages. Also, because of the space constriction manifolds which have been used in the past to supply the air-fuel mixture to the cylinders have been different in configuration for the front cylinder and rear cylinder thus having a detrimental effect on performance.

SUMMARY OF THE INVENTION

The present invention provides for a multiport manifold in which a single manifold piece or casting has a plurality of separate passages therethrough, one for connecting a carburetor to each cylinder. The passages are identical in configuration thus permitting identical performance from each cylinder. Further, the passages are configured to retain a constant cross-sectional area throughout their length even though the actual shape varies, therefore no flow constrictions are presented. Specifically, the ports at each end of the passage are circular to mate with circular ports in the cylinder and carburetor, but a central portion of the passage is rectangular having a height greater than a width in order to maintain an identical cross-sectional area through the passage while permitting multiple separate passages to run side-by-side in a constricted area.

In a preferred embodiment, wherein such a manifold is used with a two cylinder V-twin Harley Davidson motorcycle engine, two passages are provided in the manifold.

The two passages are mirror images of each other and each passage has an upstream half which is a mirror image of a downstream half. Therefore, flow through the manifold is unrestricted in any manner thereby boosting performance of the engine.

BRIEF DESCRIPTION OF THE DRAWINGS

FIG. 1 is a side elevational view of a motorcycle engine including a manifold embodying the principles of the present invention.

FIG. 2 is a side elevational view of a manifold of the present invention.

FIG. 3 is a partial top sectional view of the manifold of FIG. 1.

FIG. 4 is a side sectional view of the manifold taken generally along the line IV—IV of FIG. 3.

FIG. 5 is a sectional view of the manifold taken generally along the line V—V of FIG. 4.

FIG. 6 is a sectional view of the manifold taken generally along the line VI—VI of FIG. 4.

DESCRIPTION OF THE PREFERRED EMBODIMENTS

Although the present invention provides for a manifold with multiple passages therethrough for connecting a plurality of carburetors to a same number of engine cylinder inlet ports, the invention finds particular utility in use with a two cylinder motorcycle engine and a preferred embodiment of the invention will be disclosed in that context.

In FIG. 1 there is illustrated a portion of a motorcycle generally at 10 such as a Harley Davidson motorcycle which has an engine commonly referred to as a V-twin. Such an engine includes a forward cylinder 12 and a rear cylinder 14 which are mounted in alignment front to rear, or longitudinally on a frame 15 of the motorcycle but which are angled relative to one another such that the front cylinder 12 is angled slightly forwardly and the rear cylinder 14 is angled slightly rearwardly. The intake ports for the air-fuel mixture for the two cylinders are located adjacent to one another. That is, the inlet port for the forward cylinder is located on a rear side of the cylinder and the inlet port for the rear cylinder is located on a forward side so that the two ports face each other in the V gap between the two cylinders. The exhaust ports are located on opposite sides of the cylinder, the forward cylinder having an exhaust port exiting from the front side of the front cylinder and the exhaust port for the rear cylinder exiting from the rear side.

In order for the air-fuel mixture to be supplied to the cylinders, a manifold 20 is required which carries the air-fuel mixture from the carburetors to the cylinders, the manifold being positioned in the V space between the two cylinders.

The manifold 20 incorporating the principles of the present invention is shown in greater detail in FIGS. 2–6. The manifold 20 is a single piece casting with two separate passages 22, 24 therethrough, each passage having a circular outlet port 26 and a circular inlet port 28. A flange 30 with two opposed apertures 32 therethrough is provided at the inlet port to permit a mounting of the carburetors to the manifold. An outlet end has a machined diameter external surface 34 for mounting to the cylinders.

The two passages 22, 24 are mirror images of each other and therefore provide identical flow paths through the manifold 20. Each passage 22, 24 is a mirror image of itself with respect to an inlet or upstream half and an outlet or downstream half divided generally along the line V—V or VI—VI of FIG. 4. Each end of the passage 22, 24 is circular in shape, the two ends having an identical diameter and thus identical cross-sectional areas. Because of the confined space between the two cylinders 12, 14 and the need to cause a change of direction of the air-fuel mixture flowing through the manifold from the separate carburetors to the separate cylinders, there is not sufficient room to have two side-by-side passages of a circular cross-sectional shape with a diameter constant in size to the carburetor outlet and cylinder inlets. Therefore, the passages have a rectangular cross-sectional shape as illustrated in FIGS. 5 and 6 at a center portion 35 of the passage, the rectangular shape being greater in height than in width. The cross-sectional area of the rectangular portion of the passage is identical to the cross-sectional area at the inlet port and outlet port of the manifold and, this cross-sectional area is maintained through a transition zone 36 between the cylindrical portions of the passage and the rectangular portions of the passage thereby providing passages which, although they change in shape configuration, maintain a constant cross-sectional area to prevent any constricted flow passages which would detrimentally affect engine performance.

A mounting tab 37 with an aperture 38 therethrough is provided on a bottom side of the manifold to permit the attachment of a rigid brace member 40 to the manifold and to the motorcycle engine or frame 15 to support the weight of the manifold and carburetors to prevent movement of the manifold relative to the engine intake ports especially in conditions of excessive vibration.

Thus, the invention provides a manifold for use with an engine having a plurality of inlet ports, to connect plurality of the inlet ports to an equal number of carburetors. The manifold comprises a single piece member or casting having a plurality of passages therethrough equal in number to the connected plurality of inlet ports. The passages each extend from an inlet port adapted to mount to one of the carburetors to an outlet port adapted to mount to one of the engine inlet ports. The passages are independent from each other and have a constant cross-sectional area throughout their length. Preferably each passage is identical in length and cross-sectional area to all other passages. The exact cross-sectional shape of the passage may vary along its length to accomodate space restrictions in the mounting locale of the manifold.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. A manifold for use with an engine having a plurality of inlet ports, to connect a plurality of said inlet ports to an equal number of carburetors, comprising:

a single piece manifold having a plurality of passages therethrough equal in number to said connected plurality of inlet ports, said passages each extending from an inlet port adapted to mount to one of said carburetors to an outlet port adapted to mount to one of said engine inlet ports, said passages each being independent from any other passage, and said passages each having a constant cross-sectional area throughout its length.

2. A manifold according to claim 1, wherein each of said passages are identical in length and cross-sectional area to each other.

3. A manifold according to claim 1, wherein at least one of said passages has a varying cross-sectional shape throughout its length while maintaining said constant cross-sectional area.

4. A manifold for use with an engine having two inlet ports, to connect said two inlet ports to two separate carburetors, comprising:

a single piece manifold having two separate and independent passages therethrough, said passages each extending from an inlet port adapted to mount to one of said carburetors to an outlet port adapted to mount to one of said engine inlet ports, said passages each having a constant cross-sectional area and a varying cross-sectional shape throughout its length.

5. A manifold according to claim 4, wherein both passages have an identical length and cross-sectional area.

6. A manifold according to claim 4, wherein said manifold includes a mounting tab projecting therefrom to provide an additional attachment point for said manifold.

7. A manifold for use with a two cylinder motorcycle engine, wherein said cylinders are mounted on a frame of a motorcycle in longitudinal alignment relative to said frame, but angled relative to each other in a V configuration wherein a front cylinder is angled slightly forwardly and a rear cylinder is angled slightly rearwardly and a V-shaped space is provided between said cylinders, said cylinders each having an inlet port opening to said V-shaped space, and wherein two separate carburetors are used on said motorcycle, said manifold comprising:

a single piece casting having two separate and independent passages therethrough, said passages each extending from an inlet port adapted to mount to one of said carburetors to an outlet port adapted to mount to one of said engine inlet ports, said passages being identical in length and cross-sectional area and each having a constant cross-sectional shape through its length.

8. A manifold according to claim 7, wherein said casting includes a mounting tab projecting therefrom to provide a point for attaching said casting to said motorcycle engine or frame.

9. A manifold according to claim 7, wherein each of said passages has a circularly shaped inlet port and outlet port and has a rectangular cross-sectional shape intermediate said two ports.

* * * * *